US009746300B1

(12) United States Patent
Anderson et al.

(10) Patent No.: US 9,746,300 B1
(45) Date of Patent: Aug. 29, 2017

(54) VOLTAGE INDUCED POROSITY IN INSENSITIVE MUNITION

(71) Applicant: The United States of America as Represented by the Secretary of the Army, Washington, DC (US)

(72) Inventors: Paul Anderson, Ogdensburg, NJ (US); Alex Paraskos, Sparta, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/019,010

(22) Filed: Feb. 9, 2016

Related U.S. Application Data

(63) Continuation-in-part of application No. 14/224,529, filed on Mar. 25, 2014, now abandoned.

(51) Int. Cl.

| | |
|---|---|
| ***D03D 23/00*** | (2006.01) |
| ***D03D 43/00*** | (2006.01) |
| ***F42C 11/00*** | (2006.01) |
| ***F42B 12/20*** | (2006.01) |
| ***F42C 19/08*** | (2006.01) |
| ***C06B 23/00*** | (2006.01) |

(52) U.S. Cl.
CPC ..... *F42C 11/008* (2013.01); *C06B 23/004* (2013.01); *F42B 12/207* (2013.01); *F42C 19/0838* (2013.01)

(58) Field of Classification Search
USPC ..... 149/108.2, 108.6, 108.8, 109.4
See application file for complete search history.

(56) References Cited

U.S. PATENT DOCUMENTS 8,048,241 B1 * 11/2011 Davison ..... C06B 27/00 149/109.6

OTHER PUBLICATIONS

Crane, Charles A., et al., Utilizing Microwave Susceptors to Visualize Hot-Spots in Trinitrotoluene, Journal of Microwave Power and Electromagnetic Energy, 48 (1), 2014, pp. 5-12, International Microwave Power Institute.
Vargas, Evan, et al., Advanced Susceptors for Microwave Heating of Energetic Materials, Materials and Design 90 (2016) 47-53, Elsevier.
Šimkova, L., et al., Electrochemically initiated degradation of a new energetic material 2,2-didnitroethene-1,1-diamine (FOX-7), ECS Transactions, 35 (16) 11-15 (2011), The Electrochemical Society.

* cited by examiner

*Primary Examiner* — James McDonough
(74) *Attorney, Agent, or Firm* — Lisa H. Wang

(57) ABSTRACT

A method of selectively increasing the sensitivity of an insensitive munition by inducing porosity or Joule heating in munitions assembly comprising a power source, an explosive apparatus and a fuze apparatus wherein the explosive apparatus contains a sensitized main explosive composition comprising a secondary explosive and a sensitizing agent. As a result, the otherwise insensitive munition is rendered sensitive to a propagating wave shock by approximately 10 to 25%. To this end, a voltage is applied across the main conductive explosive composition within the insensitive munition. Voltages above certain thresholds cause the decomposition of the explosive material or conductive binder, which leads to an increase in porosity, and therefore the shock sensitivity.

15 Claims, 2 Drawing Sheets

VOLTAGE INDUCED POROSITY IN INSENSITIVE MUNITION

FEDERAL INTEREST STATEMENT

The inventions described herein may be manufactured, used and licensed by the United States Government for United States Government purposes without payment of any royalties thereon or therefore.

RELATED APPLICATIONS

The present application is related to co-pending U.S. application Ser. No. 14/224,529 filed Mar. 25, 2014 which is incorporated herein in its entirety.

FIELD OF THE INVENTION

The present invention relates in general to the field of energetic materials in explosive compositions. In particular, the present invention relates to methods and compositions for rendering an otherwise insensitive munition more amenable to detonation. More specifically, the insensitive munition is sensitized through voltage application, resulting in porosity formation or increase in temperature in the explosives.

BACKGROUND OF THE INVENTION

The U.S. Department of Defense is currently moving toward the long-term goal of insensitive munition-compliant inventory. The acquisition treatment of insensitive munitions was the subject of a Jan. 26, 1999, memorandum from the Under Secretary of Defense for Acquisition, Technology and Logistics. The overall intent of the memorandum was to focus scarce resources on forward fit incorporation of insensitive munition-compliant technology.

Insensitive munition is expected to save lives and material. As defined in STANAG 4439, insensitive munitions mean: "Munitions which reliably fulfill their performance, readiness and operational requirements on demand, but which minimize the probability of inadvertent initiation and severity of subsequent collateral damage to weapon platforms, logistics systems and personnel when subjected to unplanned stimuli."

"Unplanned stimuli" include thermal and mechanical impact threats of Fast Cook-Off (FCC), Slow Cook-Off (SCO), Bullet Impact (BI), Fragment Impact (FI), Sympathetic Detonation (SD), Shaped Charge Jet (SCJ), and Spall Impact (SI) as presented in MIL-STD-2105B.

The memorandum adds: "All munitions and weapons shall be designed to conform with insensitive munitions (unplanned stimuli) criteria and to use materials consistent with safety and interoperability requirements. Requirements shall be determined during the requirements validation process and shall be kept current throughout the acquisition cycle for all acquisition programs. Interoperability, to include insensitive munitions policies, shall be certified per CJCSI 3170.01A." "The ultimate objective is to design and field munitions which have no adverse reaction to unplanned stimuli, analogous to Hazard Division 1.6 (TB 700-2/NAVSEAINST 8020.8B/T.O. 11A-1-47/DLAR 8220.1, "Department of Defense Ammunition and Explosives Hazard Classification Procedures")."

As a result, efforts have been made to render the insensitive munition more amenable to detonation. One such effort is described in U.S. patent application, publication No. 2006/0011083 A1. This publication generally describes methods and compositions for microwave heating of energetic materials. It proposes mixtures for high explosives with materials that absorb microwaves resulting in a net temperature increase and therefore detonate at lower shock pressures when exposed to microwave energy than the corresponding neat explosives.

It would however be desirable to provide other formulations and methods for rendering insensitive munition amenable to detonation of lower shock pressures, and as such change from a relatively shock insensitive formulation to a shock sensitive formulation.

SUMMARY OF THE INVENTION

The present invention satisfies this need and describes novel embodiments of methods and compositions for rendering insensitive munition more sensitive to shock input. More specifically, the insensitive munition is sensitized with the introduction of voltage induced porosity or Joule heating from electrical current flow in the explosives.

More specifically, all explosives possess a certain shock sensitivity and detonation velocity. These properties are related to the magnitude of shock input (both time and amplitude) and how the material decomposes to its elements during the shock event.

The present invention describes embodiments to tailor the detonation of a main explosive by the decomposition of a sensitizing agent such as a binder or a sensitized explosive itself, in order to increase the extent of porosity or the temperature of the explosive. Both the increase in porosity and/or temperature is known to lead to an increase in shock sensitivity as well as a decrease in critical diameter.

The main explosive that is modified according to the present invention would be insensitive for shipment and storage, but upon exposure to a certain voltage stimulation, would become almost instantly sensitive to shock. The present invention envisions various forms of voltage-induced porosity or temperature changes in explosives and binder materials.

In a particular embodiment, a system of ionic nature can respond to electrical impetus (such as DEMN salts, composed of a melt eutectic of diethylenetriamine tetranitrate (DEIN), ethylenediamine dintrate (EDD), and methyl nitroguanidine (MeQN); carbohydrazide based nitrate and perchlorate salts; triaminoguanidinium salts (such as TAGzT, TAGmNT, etc), trifluoroacetic acid aminoguanidine, and related ionic solids. Because of charge separation in these materials and protonated amine groups, certain amounts of charge carriers flow in the materials, depending on the voltage. Moreover, certain additives, such as carbon nanotubes, graphite, graphene, copper powder, carbon black, aluminum and others serve to further adjust resistivity of material and heat capacitance which leads to more effective Joule heating due to increased current flow upon application of voltage potential. It is envisioned that other materials could be used that also decompose to form less dense products. Recent work shows that 2,2-dinitroethene-1,1-diamine (FOX-7) decomposes into gaseous detonation-like products upon application of a voltage potential (L. Simkova, J. Ludvik, "Electrochemically initiated degradation of a new energetic material 2,2-dinitroethene-1,1-diamine (FOX-7)", ECS Transactions, 35(16), 2011, 11-15.). It is also known that organic molecules break down upon exposure to certain voltage potentials. Therefore it is likely that all organic chemical explosives are amenable to such breakdown. Once breakdown occurs, a decrease in density and increase in porosity of the bulk insensitive secondary explosive occurs.

In general, most if not all solids or liquids at some level exhibit the decomposition behavior. The factors that yield such behavior include, but are not limited to, capacitance, dielectric constants, thermal conductivity, electrical conductivity, and chemical composition.

As an example, mixtures of gelled hydroxylammonium nitrate (HAN) or carbohydrazide nitrate (CHN) show extensive bubble formation with application of up to 50 volts and limited current. Simple TNT impregnated with nanotubes, when exposed to 50V for extended periods of time, shows evidence of nitrate decomposition and heating to the melt point of 81° C. Based on the assumption that about ten percent of the explosive decomposes upon electrical stimulation it will result in more than five percent porosity, which is amply sufficient to significantly change the shock sensitivity and critical diameter of the explosive. Changes in detonation velocity are observed in computational thermodynamic calculations that assume certain decomposition products.

The present invention generally encompasses a munition assembly comprising a power source apparatus, an explosive apparatus comprising a main explosive composition comprising a secondary explosive and a sensitizing agent wherein said composition is in association with a first and second conductive path wherein such conductive paths are coupled to the cathode and anodes electrodes of the power source, and a fuze apparatus.

The sensitizing agent of contemplated in the present invention comprises at least one member selected from the group consisting of a polymer, ionic liquid or ionic solids, solid conductive additives, sensitized explosive material or melt phase binder.

Conductive solids that may function as sensitizing agents of the present invention include carbon or graphite nanotubes, graphene, graphite, copper particles, aluminum particles, and carbon black.

Sensitized explosive material may also act as sensitizing agents. Such explosive material include octahydro-1,3,5,7-tetranitro-1,3,5,7-tetrazocine (HMX), 1,3,5-Trinitroperhydro-1,3,5-triazine (RDX), 2,2-dinitroethene-1,1-diamine (FOX-7), [1,3 dinitropyrazole (DNP), methyl dinitro triazole (MDNT), or 3-nitro-1,2,4-triazole-5-one (NTO).

Sensitized agents may further comprise ionic liquids and solids such as those that respond to electrical stimulus including diethylenetriamine tetranitrate (DETN), ethylenediamine dinitrate (EDD), or methyl nitroguanidine (MeQN). Such ionic liquid or solid of may further comprise an anion and cation and is solid below 100° C.

The munition assembly as disclosed herein comprises of the secondary explosive having a resistivity of about $10^{-4}$ to 2000 ohm-m.

Further disclosed herein are methods to prevent initiation of a sensitized munition upon launch by increasing the sensitivity of an insensitive munition after launching the sensitized explosive apparatus above 8000'G.

In summary, the present invention presents the ability to control the detonation characteristics of insensitive secondary explosives by use of ionic solids and/or liquids, conductive additives, and/or solids amenable to decomposition by voltage differential using embedded electrodes and exposing the explosive to voltage and/or current over a certain period of time. The primary measurable responses changed will be shock sensitivity and critical diameter.

BRIEF DESCRIPTION OF THE DRAWINGS

The above and other features of the present invention and the manner of attaining them, will become apparent, and the invention itself will be best understood, by reference to the following description and the accompanying drawings.

DETAILED DESCRIPTION OF PREFERRED EMBODIMENTS

The present invention generally describes explosives compositions, and in particular to insensitive compositions that require substantial shock inputs and large diameters to initiate. A preferred embodiment of the present invention permits a decrease in shock sensitivity by at least 10%, with a desired amount in the range of 25% or more, and a decrease in critical diameter by 10%, with a desired amount in the range of 25% or more.

Figure 1:
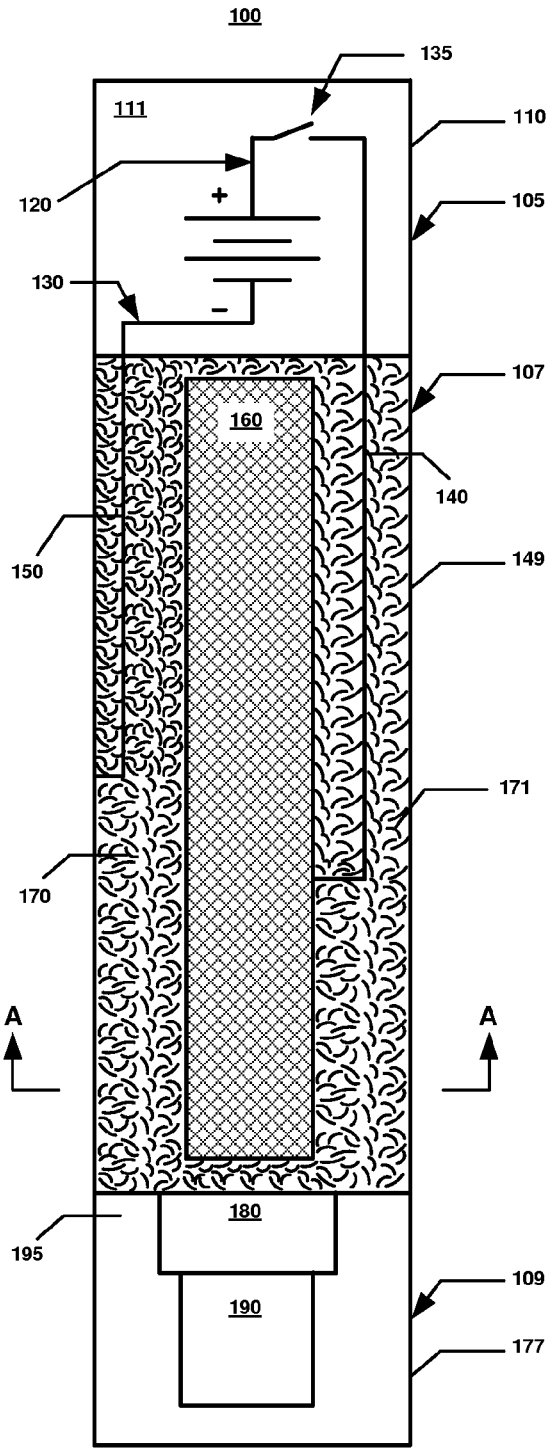
FIG. 1 is a notional representation of an electrically sensitized warhead (or munition) according to a preferred embodiment of the present invention.
Figure 2:
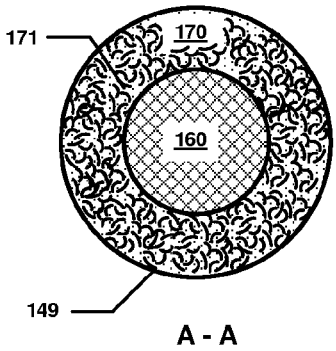
FIG. 2 is a cross-sectional view of the warhead of FIG. 1, taken along line A-A thereof.

FIGS. 1 and 2 illustrate a warhead (also referred to herein as "munition") 100 that is sensitizable according to the present invention. The warhead 100 generally includes a power source compartment 105, an explosive compartment 107, and a fuzing compartment 109. These compartments 105, 107, and 109 are electrically insulated from each other in order to prevent voltages leakage and potential arcing.

Considering now the power source compartment 105 in more detail, it generally includes a casing or shell 110 that is preferably made of a conductive medium in contact with the secondary explosive, which is conductive. If a different electrode configuration is used, and the steel casing is not used as the anode, an insulation barrier must be used between the cathode and the steel casing. Although in FIG. 1, the casing 110 is shown as being cylindrically shaped, it should be understood that other shapes are also contemplated by the present invention.

The power source compartment 105 also includes a DC or AC power source, such as a battery and related electronic control 111. The power source 111 has an anode 120 and a cathode 130. In the present exemplary embodiment, a normally open switch 135 is placed in series with the anode so as to enable control of the sensitization of the warhead 100. It should be clear that the switch 135 could be located at another location along the current path.

The switch 135 could be closed either by a direct, wired connection to an initiation train 190 of the fusing compartment 109, or wirelessly from a remote location. To this end, the switch 135 may include components, such as a receiver, that are not shown in FIG. 1, but that are known or available, and thus they will not be described herein.

Considering now the fusing compartment 109 in more detail, it generally includes a shell 177 that is generally shaped similarly to the shells 110 and 149. The composition of the shell 177 is preferably, but not necessarily, similar to those of the shells 110 and 140.

The fusing compartment 109 further includes a booster explosive 180, an initiation train 190, and optionally a payload 195. Examples of the booster explosive 180 and the payload 195 are known in the field and thus they will not be described in detail. The initiation train 190 includes the fuzing and other electronic components that control the operation of the warhead 100.

Considering now the explosive compartment 107, it generally includes a casing or shell 149 that is preferably made of steel or other conductive material. Although in FIG. 1, the casing 149 is shown as being cylindrically shaped, it should be understood that other shapes are also contemplated by the present invention.

The casing 149 is electrically connected to the cathode 130 by means of a conductor 150. As a result, the casing 149 has the same potential as the cathode 130, and thus acts as a cathode. However, the casing does not necessarily have to act as the cathode. In another embodiment or configuration, the cathode can be a separate web or conductive material surrounding the secondary explosive material 170 and insulated from the casing 149.

The explosive compartment 107 further includes a central electrode 160 that is preferably, but not necessarily, axially located within the explosive compartment 107, at a distance from the shell 149. The central electrode 160 is electrically connected to the anode 120 by means of a conductive path 140. As a result, the central electrode 160 has the same potential as the anode 120, and thus acts as an anode.

The explosive compartment 107 contains the main secondary explosive material 170, between the central electrode 160 and the casing 149. An important aspect of the present invention is the addition of a sensitizing agent 171 to the main explosive material 170. The sensitizing agent 171 increases the sensitivity of the main explosive material 170 with the introduction of voltage induced porosity or Joule heating from electrical current flow in the main explosive material 170.

The main explosive material 170 can be any one of the following classes of secondary explosives: melt pour, cast cure, and pressed. A melt pour class includes any class of explosives that can be melted using steam kettle equipment, typically with melting points from 80-110° C. TNT (trinitrotoluene) possesses a melt point of 85° C. Upon melting, the material is casted and allowed to cool and solidify. Solid explosive content is usually less than 60% by weight due to viscosity considerations.

The cast cure class includes any class of explosives in which an uncured polymer is used as the matrix for solid explosives. Traditionally, these include hydroxyterminated polybutadiene (HTPB) and epoxies, and then the solid explosive is mixed into the matrix with high shear. Catalysts and cross-linkers are added, the material poured into the desired casting or shape, and the plastic then cures over time. The result is a rubbery or hard explosive composite. Solid explosive content is anywhere from 50-90% by weight.

The pressed class includes any class of explosives, usually high performance, where a binder is mixed with solid explosives. The binder coats the explosive as granules, which are then pressed at high pressure into the fixture or shell. Usually the amount solid explosive content is quite high, 85-98% by weight.

The sensitizing agent 171 can be any one or more of the following classes of materials: conductive polymers, ionic liquids or solids, or solid conductive additives. The conductive polymers class includes binders such as such as polyaniline, polypyrole, or glycidyl azide polymers. Solid conductive additives such as graphite, graphene, carbon black, graphitic carbon black, carbon nanotubes, multiwalled carbon nanotubes, graphite nanofibers, and/or graphite nanoplatelets; and metal powders such as copper, silver, etc.

The ionic liquids or solids class is of an ionic nature that responds to electrical impetus such as DEMN salts; composed of a melt eutectic of diethylenetriamine tetranitrate (DETN), ethylenediamine dintrate (EDD), and/or methyl nitroguanidine (MeQN); carbohydrazide based nitrate and perchlorate salts; triaminoguanidinium salts such as TAGzT, TAGmNT, etc.; trifluoroacetic acid aminoguanidine, and related ionic solids.

Explosives that respond to electrical potential include 2,2-dinitroethene-1,1-diamine (FOX-7), trinitrotoluene (TNT), methyl dinitro triazole (MDNT), 1,3 dinitropyrazole (DNP), octahydro-1,3,5,7-tetranitro-1,3,5,7-tetrazocine (HMX), 1,3,5-Trinitroperhydro-1,3,5-triazine (RDX), or any organic molecule that responds to electrical potential by decomposition into lighter molecular weight products and gases.

The sensitization of the warhead 100 depends on the type and application of the munition, such as the warhead 100. For the purpose of the present invention, the munition can be generally classified into two categories: high-G applications and low-G-applications.

The high-G munitions are required to sustain higher gravity loads, usually above 8,000. The high-G munitions include for example artillery, guns, and similar other munitions.

The present invention recommends that the high-G munitions be sensitized during flight, in order to prevent initiation upon launch. The reason for this recommendation is that the added porosity will induce sensitivity, which is not desirable until after the munition has been launched.

The low-G munitions are required to sustain lower gravity, such as less than approximately 8,000. The low-G munitions include for example hand and tube launched grenades, demolition items, and similar other munitions.

The present invention recognizes that low-G munitions could be sensitized before launch or upon imminent use since the G-loads would not impart significant porosity to initiate detonation.

In one embodiment, the sensitization of the warhead 100 is initiated, at the proper timing, by closing the power switch 135 for example and, thereby causing the shell 149 and the central electrode 160 to be energized. As a result of this current flow, the selection of the sensitizing agent 171 determines whether the sensitization occurs by the induction of heat or porosity.

The initiation of the main explosive 170 is dependent upon its ability to carry the shock wave from the booster explosive 180. If the main explosive 170 cannot carry the shock wave as is, initiation of the booster charge 180 will not cause it to detonate. However, the induced porosity and/or the increase in temperature leads to an increase in shock sensitivity as well as a decrease in critical diameter, the shock wave will propagate through the main explosive 170 and cause it to detonate.

In summary, the present invention utilizes Joule heating and/or electrical decomposition with conductive explosive composites to sensitize an insensitive secondary explosive as defined by STANAG 4439 and TB-700-2. In so doing, an otherwise insensitive secondary explosive is rendered sensitive to shock by 10-25% by production of porosity or heating or both. Both porosity and heating lead to a decrease in run to detonation, which is correlated with the critical, or "failure" diameter of a munition.

Therefore, with certain amounts of voltage applied across the conductive explosive composite will lead to a temperature increase and thus an increase in shock sensitivity. Above certain voltage thresholds, decomposition of the main explosive material 170 or conductive binder occurs, which leads to an increase in porosity, and therefore the shock sensitivity, of the explosive composite that is comprised of the main explosive 170 and the sensitizing agent 171). To achieve these responses, the explosive composite must have a certain resistance and heat capacity to ensure adequate transfer of electrical energy into the bulk explosive.

Figure 3:
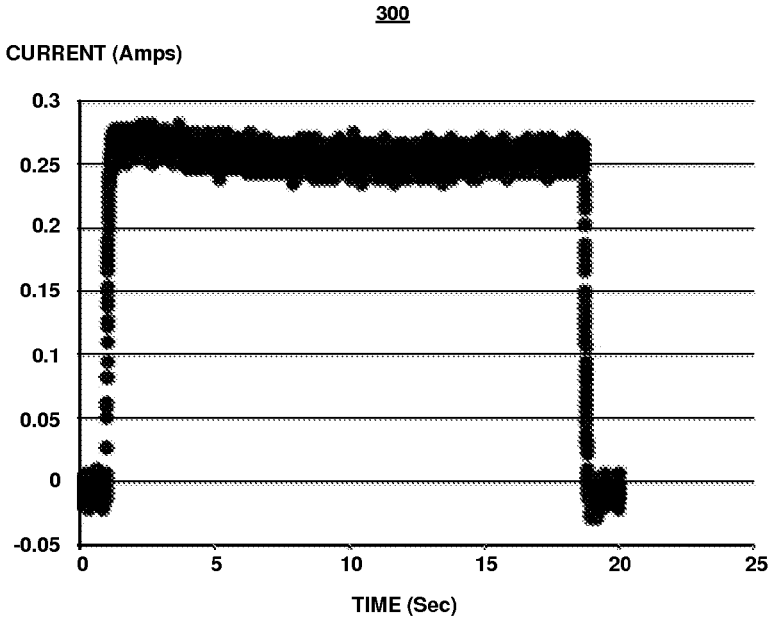
FIG. 3 is a graph illustrating an increase in the electrical current within the explosives, according to one experiment using the present invention.

The following non-limiting examples will be described in connection with FIGS. 2, 3, and 4.

Example 1

In this example, the explosive compartment 107 includes a right cylinder of 20 cm in length by 8 cm in diameter, with a density of 1.62 g/cc and with a material resistance of 50 Ω-m. will theoretically heat by 50° C. in about 5 seconds. This is well within the flight window of a long range artillery and some mortar systems.

Example 2

In this example, the explosive compartment 107 has a 0.75-inch diameter by 1-inch length pellet of 50% HMX/45% AGGTFA (aminoguanidine guanidine trifluoroacetic acid) with 5% conductive additive (sensitizing agent 171) and was subjected to 50 volts and 20 seconds of exposure. At the end of the experiment, the central portion of the main explosive 170 had melted, indicating the temperature was above the melt point of AGGTFA (85° C.). FIG. 3 is a graph 300 that illustrates an increase in the current of the main explosive 170, according to this experiment.

Example 3

Figure 4:
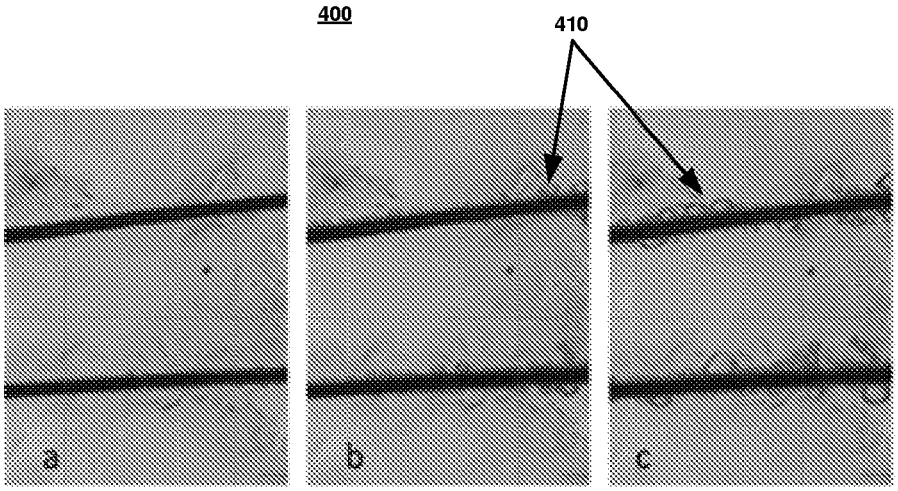
FIG. 4 is comprised of FIGS. 4A. 4B, 4C, and illustrates three slides of optical micrographs from various experiments according to the present invention.

FIG. 4 is a series of optical micrographs 400 from tests using carbohydrazide nitrate at 50V at various times (a) time=0 second; (b) time=5 seconds; and (c) time=10 seconds. The bubbles 410 resulting from increased porosity, form along both the anode 160 and the cathode 149, indicating a reduction-oxidation of the carbohydrazide nitrate salt occurs.

A preferred simple embodiment is 5% graphitic multi-walled carbon nanotubes dispersed in trinitrotoluene (TNT), a common melt-pour explosive. Resistivities on the order of 5-500 Ω-m are commonly encountered in such material.

It should be understood that other modifications may be made to the present sensitization methods without departing from the spirit and scope of the invention. Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions.

Moreover, all statements herein reciting principles, aspects, and embodiments of the invention, as well as specific examples thereof, are intended to encompass both chemical and functional equivalents thereof. Additionally, it is intended that such equivalents include both currently known equivalents as well as equivalents developed in the future, i.e., any elements developed that perform the same function, regardless of composition.

What is claimed is:

1. A sensitizable munition assembly comprising:

(a) A power source apparatus, wherein said power source apparatus further comprises,
- a power source having a cathode and an electrode, and
- a switch that is operable in an open or closed position arranged between the power source and the explosive apparatus;

(b) An electrically insulated explosive apparatus, wherein said explosive apparatus further comprises,
- a first conductive path coupled to the cathode of the power source,
- a second conductive path to the anode of the power source,
- a main explosive composition comprising an insensitive secondary explosive and sensitizing agent, wherein said main explosive composition is in association with the first and second conductive path wherein activation of the sensitizing agent by an electric current from the power source apparatus increases the volume porosity of the secondary explosive without detonation of the munition assembly; and (c) a fuze apparatus comprising a booster explosive.

2. The sensitizing agent of claim 1, further comprising at least one member selected from the group consisting of a polymer, ionic liquid or ionic solid, solid conductive additive, sensitized explosive material or melt phase binder.

3. The polymer of claim 2, selected from the group consisting of polyaniline, polypyrole, glycidyl azide polymers, hydroxyl terminated polybutadiene, polyacrylates, or polyesters.

4. The solid conductive additive of claim 2, selected from the group consisting of carbon black, carbon nanotubes, graphite carbon black, graphite nanofibers, graphite nanotubes, graphene, graphite, copper particles, aluminum particles, and silver particles.

5. The sensitize explosive material of claim 2, selected from the group consisting of octahydro-1,3,5,7-tetranitro-1,3,5,7-tetrazocine (HMX), 1,3,5-Trinitroperhydro-1,3,5-triazine (RDX), 2,2-dinitroethene-1,1-diamine (FOX-7), [1,3 dinitropyrazole (DNP), methyl dinitro triazole (MDNT), or 3-nitro-1,2,4-triazole-5-one (NTO).

6. The sensitizing agent of claim 1, comprising diethylenetriamine tetranitrate (DETN), ethylenediamine dinitrate (EDD), or methyl nitroguanidine (MeQN).

7. The ionic liquid or solid of claim 2, comprising an anion and cation and is solid below 100° C.

8. The sensitizing agent of claim 1, comprising trinitrotoluene (TNT), methyldinitrotriazole (MDNT), dinitropyrazole (DNP), dinitroanisole (DNAN), or dinitroimidazole (DNI), carbohydrazide based nitrate and perchlorate salts, triaminoguanidinium based salts, TAGzT, TAGmNT, and trifluoroacetic acid aminoguanidin.

9. The sensitizable munition assembly of claim 1, wherein the resistivity of the secondary explosive is $10^{-4}$ to 2000 ohm-m.

10. The sensitizable munition assembly of claim 1, wherein the insensitive secondary explosive composition comprises trinitrotoluene (TNT) or hydroxyterminated polybutadiene (HTPB).

11. The sensitizable munition assembly of claim 1, wherein the insensitive secondary explosive is trinitrotoluene (TNT) and the sensitizing agent is graphite or carbon nanotube.

12. A process for increasing the sensitivity of the munition in claim 1, comprising activating the power source assembly of the munition in claim 1 to increase the porosity or the temperature of the main explosive composition within the explosive apparatus.

13. A process for increasing the sensitivity of an insensitive munition at gravity greater than 8000 G's comprising a sequence of steps in the following order:

(a) launching the explosive apparatus in the munition assembly of claim 1;

(b) activating the power source apparatus to transmit a current to the main explosive composition to increase the porosity or the temperature of the main explosive composition.

14. A process for increasing the sensitivity of an insensitive munition at gravity less than 8000 G's comprising a sequence of steps in the following order:

(a) Activating the power source assembly of the munition assembly of claim 1 to increase the porosity or the temperature of the main explosive composition within the explosive apparatus;

(b) launching the explosive apparatus in the munition assembly of claim 1.

15. A sensitizable munition assembly comprising:

(a) A power source apparatus, wherein said power source apparatus further comprises, a power source having a cathode and an electrode, and a switch that is operable in an open or closed position arranged between the power source and the explosive apparatus;

(b) An electrically insulated explosive apparatus, wherein said explosive apparatus further comprises, a first conductive path coupled to the cathode of the power source, a second conductive path to the anode of the power source, a main explosive composition comprising an insensitive secondary explosive, having a resistivity of $10^{-4}$ to 2000 ohm-m, and sensitizing agent, wherein said main explosive composition is in association with the first and second conductive path wherein activation of the sensitizing agent by an electric current from the power source apparatus increases the temperature of the secondary explosive without detonation of the munition assembly; and (c) a fuze apparatus comprising a booster explosive.

* * * * *